US011378003B2

(12) United States Patent
Bogner et al.

(10) Patent No.: US 11,378,003 B2
(45) Date of Patent: Jul. 5, 2022

(54) COMPRESSOR WITH DIRECTLY DRIVEN VARIABLE IRIS DIAPHRAGM, AND CHARGING DEVICE

(71) Applicant: Vitesco Technologies Germany GMBH, Hannover (DE)

(72) Inventors: Mathias Bogner, Straubing (DE); Hartmut Claus, Grünstadt (DE)

(73) Assignee: Vitesco Technologies Germany GmbH, Regensburg (DE)

( * ) Notice: Subject to any disclaimer, the term of this patent is extended or adjusted under 35 U.S.C. 154(b) by 0 days.

(21) Appl. No.: 17/124,164

(22) Filed: Dec. 16, 2020

(65) Prior Publication Data

US 2021/0102490 A1 Apr. 8, 2021

Related U.S. Application Data

(63) Continuation of application No. PCT/EP2019/062726, filed on May 16, 2019.

(51) Int. Cl.

| | |
|---|---|
| ***F02B 39/10*** | (2006.01) |
| ***F04D 25/06*** | (2006.01) |
| ***F04D 29/18*** | (2006.01) |

(52) U.S. Cl.

CPC ..... *F02B 39/10* (2013.01); *F04D 25/06* (2013.01); *F04D 29/18* (2013.01)

(58) Field of Classification Search

CPC ..... F01D 25/24; F01D 17/141; B64D 27/10; B64D 29/06; B64D 33/02; B23P 19/10; B64C 1/10; B64F 5/10; B64F 5/60; F16B 1/00; F04D 29/464; F04D 17/10; F04D 29/4213; F04D 27/0253; F05D 2220/40; F05D 2250/51

USPC ..... 60/605.1

See application file for complete search history.

(56) References Cited

U.S. PATENT DOCUMENTS

| | | | | |
|---|---|---|---|---|
| 6,860,655 | B2 * | 3/2005 | Miyawaki | G03B 9/14 396/451 |
| 2007/0090698 | A1 | 4/2007 | Yasuda | |
| 2007/0280821 | A1 * | 12/2007 | Herrmann | F01D 17/24 415/159 |
| 2009/0095350 | A1 * | 4/2009 | Bauman | F16K 21/02 137/1 |

(Continued)

FOREIGN PATENT DOCUMENTS

| | | | |
|---|---|---|---|
| CN | 107304709 | A | 10/2017 |
| DE | 102006029370 | A1 | 1/2008 |

(Continued)

OTHER PUBLICATIONS

International Search Report dated Jul. 22, 2019 from corresponding International Patent Application No. PCT/EP2019/062726.

(Continued)

*Primary Examiner* — J. Todd Newton

(57) ABSTRACT

A compressor for a supercharging device of an internal combustion engine and a supercharging device are described. The compressor has an iris diaphragm mechanism that has a special drive. The drive includes an adjusting ring as an integral constituent part of an actuator of the drive and is formed as a rotor, which surrounds an air supply channel, of an electric motor. This results in a significantly simplified structural form of the drive.

12 Claims, 2 Drawing Sheets

(56) References Cited

U.S. PATENT DOCUMENTS

| | | | | |
|---|---|---|---|---|
| 2014/0182688 | A1* | 7/2014 | Gerber | F16K 1/221 137/1 |
| 2016/0265424 | A1 | 9/2016 | Tingaud et al. | |
| 2017/0292616 | A1* | 10/2017 | Moens | F16K 3/03 |
| 2017/0298953 | A1* | 10/2017 | Lombard | F04D 29/4213 |

FOREIGN PATENT DOCUMENTS

| | | | |
|---|---|---|---|
| DE | 102007006936 | A1 | 8/2008 |
| DE | 102009052982 | A1 | 5/2011 |
| DE | 102011121996 | A1 | 6/2013 |
| DE | 102016210011 | A1 | 12/2017 |
| EP | 3236077 | A1 | 10/2017 |
| WO | 2005073520 | A1 | 8/2005 |

OTHER PUBLICATIONS

Chinese Office Action dated Dec. 16, 2021 for corresponding Chinese Patent Application No. 201980041692.5.

* cited by examiner

COMPRESSOR WITH DIRECTLY DRIVEN VARIABLE IRIS DIAPHRAGM, AND CHARGING DEVICE

CROSS-REFERENCE TO RELATED APPLICATIONS

This application claims the benefit of International Application PCT/EP2019/062726, filed May 16, 2019, which claims priority to German Application DE 10 2018 210 085.3, filed Jun. 21, 2018. The disclosures of the above applications are incorporated herein by reference.

TECHNICAL FIELD

The disclosure relates to a compressor with directly driven variable iris diaphragm and charging device.

BACKGROUND

Such a compressor is known. For example, exhaust-gas turbochargers of internal combustion engines have such a compressor. The operating behavior of the compressor is characterized by a so-called compressor characteristic map, which describes the pressure build-up versus the throughput for different compressor rotational speeds or circumferential speeds. The stable and usable characteristic map of the compressor is bounded toward low throughputs by the surge limit, toward relatively high throughputs by the choke limit, and in terms of structural mechanics by the maximum rotational speed limit. In adapting the exhaust-gas turbocharger to the internal combustion engine, a compressor is selected which has a compressor characteristic map which is as expedient as possible for the internal combustion engine. The following preconditions would have to be satisfied here:

The engine full-load curve must lie completely within the usable characteristic map.

Additionally, the minimum clearances with respect to the characteristic map limits, as required by the vehicle manufacturer, must be maintained.

Maximum compressor efficiencies must be attained at the rated load and in the range of the low-end apex torque of the engine.

A minimal moment of inertia of the compressor must be maintained.

Simultaneously satisfying all of the preconditions is possible only to a limited extent with a conventional compressor without additional measures. For example, the following trends are contrary:

reduction of the moment of inertia of the compressor and maximization of the characteristic map width and of the peak efficiency, reduction of scavenging in the region of the low-end apex torque and maximization of the specific rated power and maximization of the maximum mean pressure of the internal combustion engine, improvement of the response behavior and increase of the specific rated power of the internal combustion engine.

The stated conflicting aims can be resolved by a compressor design which has a wide characteristic map with a minimal moment of inertia and maximum efficiencies on the full-load curve of the engine. Aside from the steady-state requirements mentioned, stable operating behavior of the compressor must also be ensured in transient operating states, for example in the case of a rapid load dump of the internal combustion engine, that is to say the compressor must not enter the state of so-called surging for a sudden decrease of the conveyed compressor mass flow.

The solutions mentioned above could be achieved by means of additional measures, such as an adjustable inlet guide vane assembly, measures for reducing the inlet cross section of the compressor, or a fixed recirculation channel. In the case of the variable solutions, the widening of the useful working range of the compressor is achieved through active shifting of the characteristic map. In this regard, during engine operation at low rotational speeds and throughputs, the compressor characteristic map is shifted to the left toward low mass flows, whereas during engine operation at high throughputs and rotational speeds, the compressor characteristic map is not shifted or is shifted to the right. Through setting of the vane angles and the induction of a pre-swirl or counter to the compressor direction of rotation, shifting of the entire compressor characteristic map toward relatively low or relatively high throughputs is realized by the inlet guide vane assembly. Here, the adjusting mechanism of the inlet guide vane assembly constitutes a delicate, complicated and expensive solution.

The measures involving constriction of the compressor inlet by cross section reduction shift the compressor characteristic map toward relatively low throughputs by virtue of the inlet cross section being reduced by closing the structure immediately upstream of the compressor. In the open state, the measures open up the entire inlet cross section again as far as possible and hence do not or only marginally influence/shift the characteristic map.

The adjusting mechanisms of the variable inlet guide vane assembly or of the cross-section-reducing measures are commonly synchronized by a slotted link mechanism, which in turn is driven or rotated by a rotary actuator with adjusting lever and a type of coupling linkage or coupling element. Such a compressor has the features described in the introduction. Here, the lamellae of the iris diaphragm mechanism are moved by the common adjusting ring. The adjusting ring has, for example, finger-like elements on its adjusting lever, into which elements a lever of the actuator shaft of the actuator engages. Here, the lamellae are guided on the adjusting ring so as to be rotatable and/or displaceable, for example by an actuating element; for example, the adjusting ring has grooves for the mounting/guidance of the lamellae.

The variable iris diaphragm mechanism therefore has the task of adjusting the inlet mass flow of the compressor. Here, the mechanism acts as a type of mask for the outer region of the compressor inlet. With increasing throttling, that is to say cross-sectional narrowing, the iris diaphragm simultaneously performs the function of an overrun air recirculation valve, since it can prevent surging of the compressor. This makes it possible to actively influence the operating range of the compressor and, in addition, to keep the compressor at a stable operating point in the event of a sudden load dump of the engine.

When the lamellae of the iris diaphragm mechanism are rotated parallel to the axis of rotation of the compressor, the lamellae pivot radially inward and thus cause a desired narrowing of the inlet cross section directly upstream of the compressor wheel. The lamellae are synchronized and moved by the adjusting ring. Rotation of the adjusting ring triggers the rotation of the lamellae. The functional principle is very similar to an iris diaphragm in a camera.

SUMMARY

The disclosure relates to a compressor for a supercharging device of an internal combustion engine. The compressor includes a compressor wheel which is arranged rotationally conjointly on a rotor shaft. The compressor also includes an air supply channel for conducting an air mass flow to the compressor wheel. The compressor also includes an iris diaphragm mechanism which is arranged upstream of the compressor wheel and which has multiple lamellae, adjustable by a rotatably mounted adjusting ring, for closing and opening a diaphragm opening, such that variable setting of a flow cross section for the air mass flow for incident flow on the compressor wheel is possible. The compressor also includes an actuator for rotating the adjusting ring and a compressor housing.

Implementations of the disclosure may include one or more of the following optional features. In some implementations, the compressor allows for the adjusting ring to form an integral constituent part of the actuator and is formed as the rotor, which surrounds the air supply channel, of an electric motor.

The solution according to the disclosure provides that the adjusting ring is no longer controlled and moved by a separate actuator, but rather forms an integral constituent part of the actuator. Rather, the adjusting ring simultaneously forms the rotor of an electric motor, such that, in the event of corresponding electrical energization of the electric motor, the adjusting ring is moved in one or the other direction, whereby the lamellae are moved to open or close the iris diaphragm mechanism, that is to say are pivoted outward or inward, and thus lead to the desired widening or narrowing of the inlet cross section of the air supply channel. The corresponding torque transmission from the adjusting ring to the lamellae may be realized here with the aid of actuating sections or actuating elements which are mounted or guided for example in grooves of the adjusting ring.

The direct drive designed according to the disclosure has numerous advantages. Previously separate functions are hereby combined in one component. This results in a high degree of integration with fewer components and a smaller space requirement. This results in less wear and improved durability of the entire mechanism.

Through the elimination of the coupling elements in the prior art, the friction is reduced. The electric motor results in advantageous response behavior and an advantageous adjustment speed with improved positioning capability and less hysteresis. The overall result is low costs, and rattling noises in the event of vibrations in the case of attachment to a turbocharger compressor on the engine can be avoided.

In the solution according to the disclosure, the adjusting ring may be formed as a rotor of a torque motor. Such torque motors are known. This is a multi-pole electrical direct drive with which very high torques can be transmitted at relatively low rotational speeds. For example, a permanently excited brushless DC motor is used here, which may be designed as an internal-rotor motor (stator at the outside, rotor at the inside). Here, the adjusting ring forms the rotor of the internal-rotor motor.

Such a torque motor may be suitable for realizing the corresponding rotational movements of the adjusting ring for the pivoting of the lamellae. Through different electrical energization of the torque motor, the adjusting ring is rotated clockwise or counterclockwise.

In some implementations, the adjusting ring has a multiplicity of permanent magnets arranged around its circumference. In some examples, a multiplicity of coils of the electric motor is positioned on the inside of the compressor housing around the circumference thereof. These coils may also be arranged on the inside of a special housing of the diaphragm mechanism or on the inside of any other fixed component.

Therefore, magnets are specially arranged on the adjusting ring or rotor, which magnets are mounted in a spaced-apart manner around the circumference of the rotor. These magnets interact with the coils arranged in a spaced-apart manner on the inside of the compressor housing or diaphragm housing. Through different electrical energization of the coils, a particular adjusting ring position is attained which constitutes equilibrium between the magnetic attraction and repulsion forces.

Magnets may be distributed over the entire circumference of the rotor and coils may be distributed over the entire circumference of the housing, or only over part of the circumference.

In some examples, the adjusting ring, the iris diaphragm mechanism and the compressor wheel are arranged in series in a flow direction of the air supply channel. The inflow channel therefore opens out directly at the adjusting ring. During operation, therefore, the flow is conducted through the adjusting ring via the diaphragm mechanism to the compressor wheel. The air flow thus simultaneously serves to cool the rotor, which acts as adjusting ring, of the electric motor.

The rotor, formed as an adjusting ring, of the electric motor may be formed such that it drives each lamella of the iris diaphragm mechanism synchronously. This may for example be implemented by virtue of each lamella having an actuating element which engages into a groove of the adjusting ring for the guidance of the respective lamella. In some examples, the adjusting ring directly drives only a main lamella of the iris diaphragm mechanism, whereas the other lamellae are driven via the respectively adjacent lamella.

The present disclosure furthermore relates to a supercharging device for an internal combustion engine having a compressor of the above-described type.

The details of one or more implementations of the disclosure are set forth in the accompanying drawings and the description below. Other aspects, features, and advantages will be apparent from the description and drawings, and from the claims.

DESCRIPTION OF DRAWINGS

Like reference symbols in the various drawings indicate like elements.

DETAILED DESCRIPTION

Figure 1:
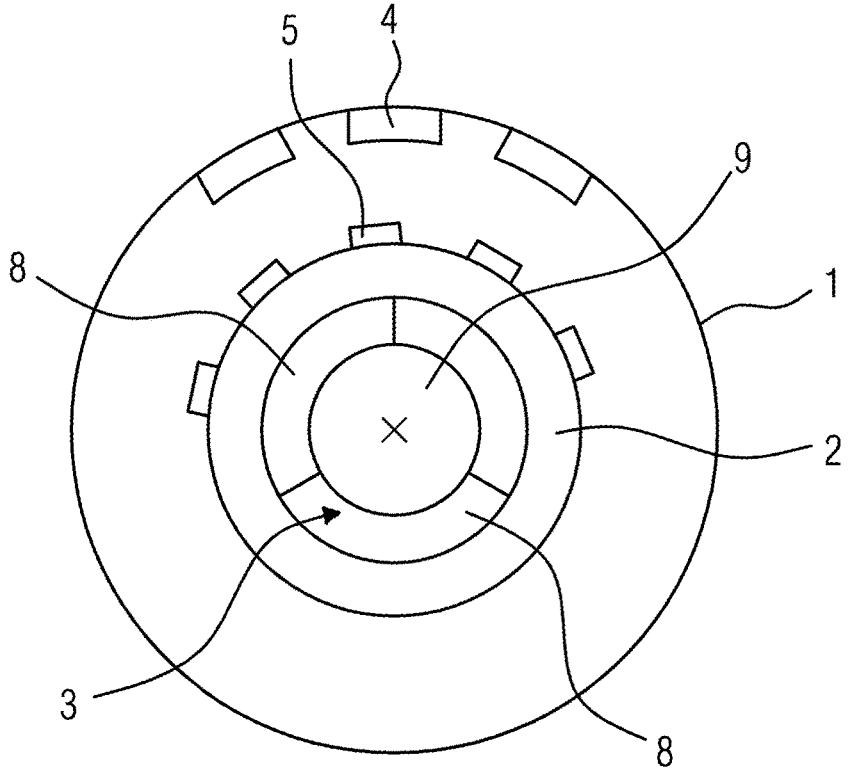
FIG. 1 is a diagrammatic illustration, from a front elevation, of the main components of a direct drive for an iris diaphragm mechanism of a compressor.

A compressor, for a supercharging device for an internal combustion engine, is equipped with a compressor wheel 7 arranged rotationally conjointly on a rotor shaft (not shown). Flow is incident on the compressor wheel 7 via an air supply channel 6. Situated upstream of the compressor wheel 7 is an iris diaphragm mechanism 3 (shown only schematically) which has multiple adjustable or pivotable lamellae 8 for closing and opening the diaphragm opening in the iris diaphragm mechanism 3, such that a flow cross section for the air mass flow for incident flow on the compressor wheel 7 is adjustable. In some examples, as shown, the iris diaphragm mechanism 3 has three lamellae 8, which adjust a corresponding diaphragm opening 9.

An adjusting ring 2 serves for the adjustment of the individual lamellae 8. The adjusting ring 2 is rotated, whereby the lamellae 8 are pivoted inward or outward for the adjustment of the diaphragm opening. For this purpose, each lamella is equipped with an actuating element which is guided in a corresponding groove (not shown) of the adjusting ring.

Permanent magnets 5 are arranged, spaced apart from one another, on the circumference of the adjusting ring 2. Coils 4 are situated in a spaced-apart manner on the inside of the circumference of the compressor housing 1 of the compressor. The compressor housing 1 with the coils 4 forms the stator, and the adjusting ring 2 with the magnets 5 forms the rotor, of a torque motor. Through different electrical energization of the coils 4, the adjusting ring 8 is rotated and thus causes inward pivoting or outward pivoting of the lamellae 8 for the adjustment of the diaphragm opening 9.

Figure 2:
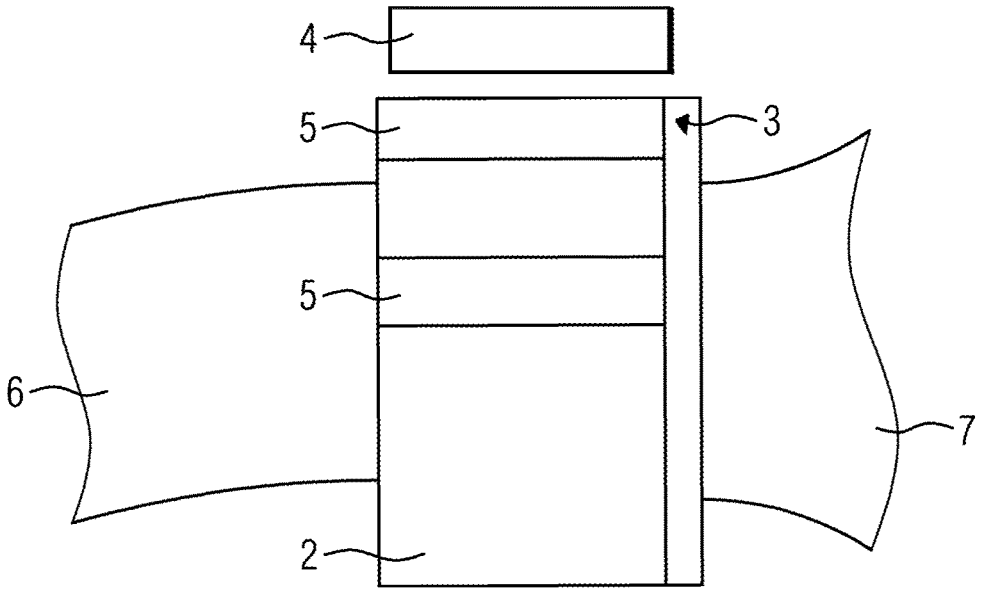
FIG. 2 is a diagrammatic illustration, from a side elevation, of the direct drive from FIG. 1.

As can be seen from FIG. 2, the diaphragm mechanism 3 is situated directly upstream of the compressor wheel 7, and the adjusting ring 2 is situated directly upstream of the diaphragm mechanism 3. The adjusting ring 2 surrounds the inflow channel 6 such that, during operation, the air flow is conducted through the adjusting ring 2 via the diaphragm mechanism 3 onto the compressor wheel 7. The air flow thus simultaneously serves to cool the rotor, which acts as adjusting ring 2.

The adjusting ring 2 is therefore integrated into the actuator for the iris diaphragm mechanism 3, and constitutes the rotor of a torque motor. The number of magnets 5 and coils 4 illustrated in the figures is merely an example. Depending on the electrical energization of the coils 4, the adjusting ring 2 is rotated to the left or to the right in FIG. 1 in order to open or close the diaphragm mechanism.

Figure 3:
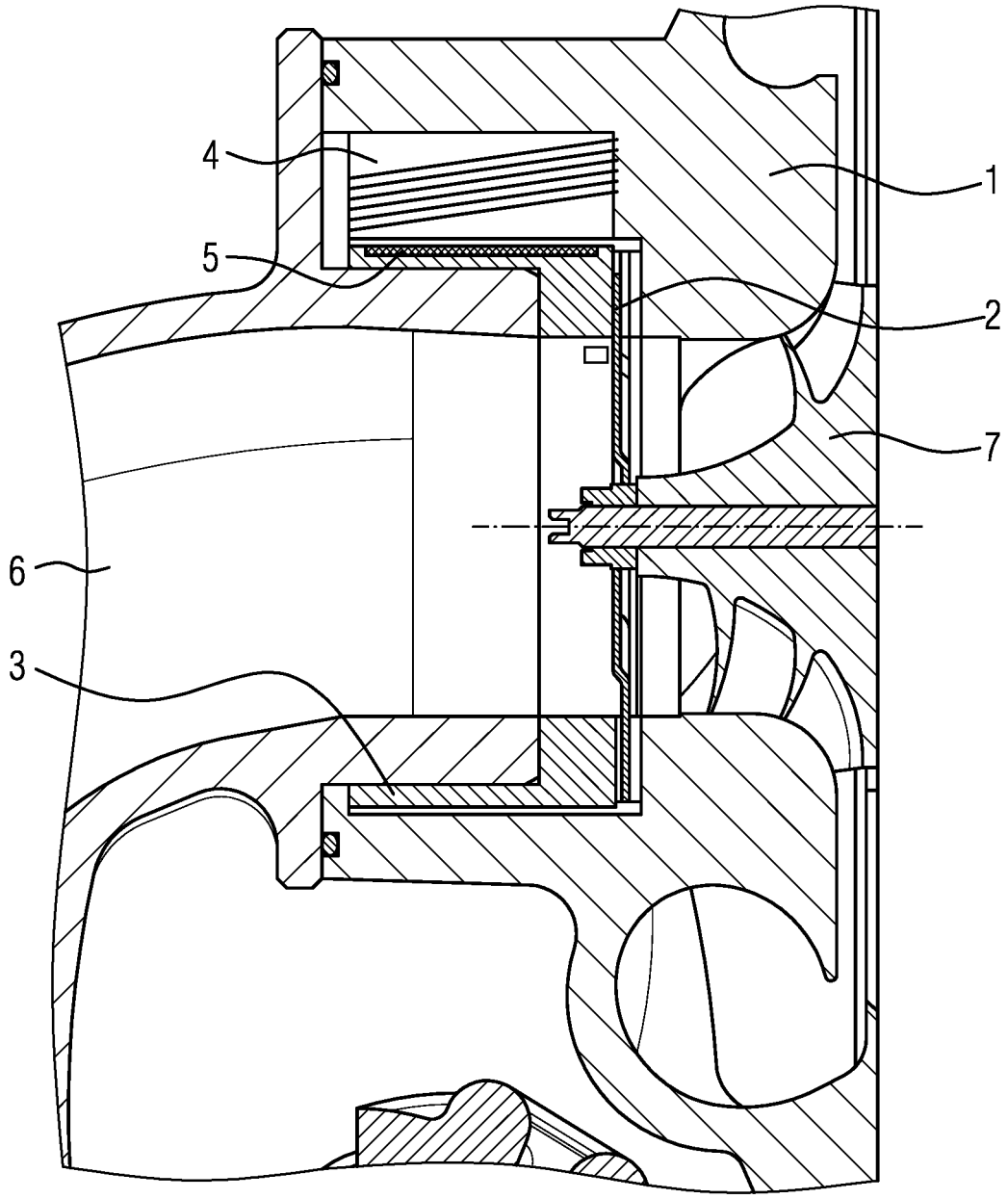
FIG. 3 is a partially sectional illustration of a compressor.

FIG. 3 shows a partially sectional illustration of a compressor equipped with an iris diaphragm mechanism 3. Flow is incident on a compressor wheel 7 via an air supply channel 6. An iris diaphragm mechanism 3 serves for the adjustment of the flow cross section.

The iris diaphragm mechanism 3 has an adjusting ring 2, over the circumference of which permanent magnets 5 are arranged. Coils 4 are provided adjacent to this in the compressor housing 1. Through electrical energization of the coils 4, the adjusting ring 2 is rotated, whereby the iris diaphragm mechanism 3 is opened or closed.

A number of implementations have been described. Nevertheless, it will be understood that various modifications may be made without departing from the spirit and scope of the disclosure. Accordingly, other implementations are within the scope of the following claims.

What is claimed is:

1. A compressor for a supercharging device of an internal combustion engine, the compressor comprising:

a compressor wheel arranged rotationally conjointly on a rotor shaft;

an air supply channel for conducting an air mass flow to the compressor wheel;

an iris diaphragm mechanism comprising multiple lamellae, a rotatably mounted adjusting ring, and a multiplicity of permanent magnets disposed on the adjusting ring, the iris diaphragm mechanism arranged upstream of the compressor wheel and, adjustable by the adjusting ring, for closing and opening a diaphragm opening, such that variable setting of a flow cross section for the air mass flow for incident flow on the compressor wheel is possible;

an actuator for rotating the adjusting ring; and a compressor housing;

wherein the adjusting ring forms an integral constituent part of the actuator and is formed as a torque generating electric motor rotor which surrounds the air supply channel.

2. The compressor as claimed in claim 1, wherein the multiplicity of permanent magnets are arranged around a circumference of the adjusting ring.

3. The compressor as claimed in claim 1, further comprising a multiplicity of coils of the electric motor positioned on the inside of the compressor housing around the circumference thereof.

4. The compressor as claimed in claim 1, wherein the adjusting ring, the iris diaphragm mechanism and the compressor wheel are arranged in series in a flow direction of the air supply channel.

5. The compressor as claimed in claim 1, wherein the adjusting ring drives each lamella of the iris diaphragm mechanism synchronously.

6. The compressor as claimed in claim 1, wherein the adjusting ring directly drives only a main lamella of the iris diaphragm mechanism.

7. A supercharging device for an internal combustion engine, the supercharging device comprising: a compressor including:

a compressor wheel arranged rotationally conjointly on a rotor shaft;

an air supply channel for conducting an air mass flow to the compressor wheel;

an iris diaphragm mechanism comprising multiple lamellae, a rotatably mounted adjusting ring, and a multiplicity of permanent magnets disposed on the adjusting ring, the iris diaphragm mechanism arranged upstream of the compressor wheel and adjustable by the adjusting ring, for closing and opening a diaphragm opening, such that variable setting of a flow cross section for the air mass flow for incident flow on the compressor wheel is possible;

an actuator for rotating the adjusting ring; and a compressor housing;

wherein the adjusting ring forms an integral constituent part of the actuator and is formed as a torque generating electric motor rotor which surrounds the air supply channel.

8. The supercharging device as claimed in claim 7, wherein the multiplicity of permanent magnets are arranged around a circumference of the adjusting ring.

9. The supercharging device as claimed in claim 7, further comprising a multiplicity of coils of the electric motor positioned on the inside of the compressor housing around the circumference thereof.

10. The supercharging device as claimed in claim 7, wherein the adjusting ring, the iris diaphragm mechanism and the compressor wheel are arranged in series in a flow direction of the air supply channel.

11. The supercharging device as claimed in claim 7, wherein the adjusting ring drives each lamella of the iris diaphragm mechanism synchronously.

12. The supercharging device as claimed in claim 7, wherein the adjusting ring directly drives only a main lamella of the iris diaphragm mechanism.

* * * * *